US009738428B2

(12) United States Patent
Blazquez Torres

(10) Patent No.: US 9,738,428 B2
(45) Date of Patent: Aug. 22, 2017

(54) BOTTLE CAP WITH BUILT-IN LIGHT

(71) Applicant: Angel Blazquez Torres, Madrid (ES)

(72) Inventor: Angel Blazquez Torres, Madrid (ES)

( * ) Notice: Subject to any disclaimer, the term of this patent is extended or adjusted under 35 U.S.C. 154(b) by 0 days.

(21) Appl. No.: 14/958,954

(22) Filed: Dec. 4, 2015

(65) Prior Publication Data

US 2017/0158387 A1 Jun. 8, 2017

(51) Int. Cl.

| | |
|---|---|
| ***B65D 51/24*** | (2006.01) |
| ***B65D 39/00*** | (2006.01) |
| ***F21V 33/00*** | (2006.01) |
| ***F21L 4/00*** | (2006.01) |
| ***F21V 31/00*** | (2006.01) |
| ***F21V 3/04*** | (2006.01) |

(52) U.S. Cl.

CPC ..... *B65D 51/245* (2013.01); *B65D 39/0058* (2013.01); *F21L 4/00* (2013.01); *F21V 3/0418* (2013.01); *F21V 31/00* (2013.01); *F21V 33/0084* (2013.01)

(58) Field of Classification Search

CPC . B65D 51/245; B65D 39/0058; F21V 3/0418; F21V 31/00; F21V 33/0084; F21L 4/00

See application file for complete search history.

(56) References Cited

U.S. PATENT DOCUMENTS

2008/0035515 A1* 2/2008 Dikopf ..... A47G 19/2227 206/457

* cited by examiner

*Primary Examiner* — David V Bruce

(57) ABSTRACT

A stopper with a built in light characterized in that it is formed from a standard stopper (1) preferably made in cork, to which an inner hollow has been carved inside (2) so that it can house an air tight cylindrical capsule (4) with a rounded top part and within which a battery (5), an electronic circuit (6) and a light providing LED (7) can be found being this air tight capsule (4) sealed on the bottom by a see through glass pane (9).

6 Claims, 2 Drawing Sheets

BOTTLE CAP WITH BUILT-IN LIGHT

OBJECT OF THE INVENTION

Figure 1:
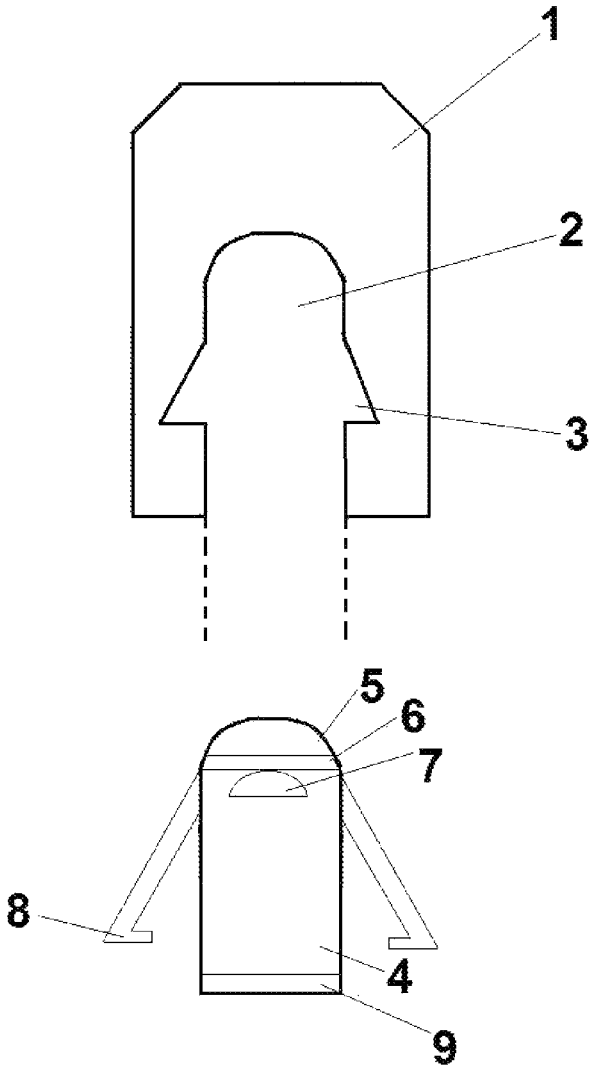

The proposed invention relates to a bottle stopper with a built in light specially developed to correctly visualize the state of the internal fluid and for liquids with bubbles verify the quantity, the quality and the size of the bubbles.

As an added side effect, the aesthetic appearance can be considered.

FIELD OF THE INVENTION

The field of the invention is the industry of bottle stoppers manufacturing and the industry of electrical and electronic component manufacturing.

BACKGROUND OF THE INVENTION

It is known since ancient times the use of all kinds of stoppers of every type to seal liquids in bottles for their transportation and storage.

In the archaeological museums there are pieces used to close vessels, with an abundance of forms, set-ups and decorative elements on top.

Since the invention of glass, bottle stoppers have been mostly made of cork for wine and of plastics for spirits, featuring many different shapes to put forth technical solutions to problems, such as non-refillable stoppers, selective air output stoppers, anti-drip stoppers and many more.

Within the research done on background art, a distant precedent has been found.

This is the WO2014196484 patent titled "Cork with light" with Egg Cube INC Japan filing as applicant and Sasakitakayuki (JP) as inventor, and date of application 2014 Dec. 11.

"The purpose of the present invention is to provide a cork with a light which can preserve sufficient rigidity in the cork proper, and can be reused. This cork with a light comprises a hollow cylindrical part (12), a retaining part (13), a light source unit (14), and a connecting part (15). The hollow cylindrical part has an inner circumference radius (12a) which is larger by a prescribed gap radius than an outer circumference (11a) of a coin cell (11), and is electrically conductive. The retaining part has a thickness (13a) which is thinner than the gap, is mounted upon the outer circumference face side of the coin cell, and is electrically insulated. The lateral light source unit has one electrical wire (14a) which is electrically connected to a lower electrode (11b) of the coin cell, and another electrical wire (14b) which is electrically connected to the inner circumference face of the hollow cylindrical part. The connecting part has one conducting wire (15a) which is electrically connected to the inner circumference face side of the hollow cylindrical part, and another conducting wire (15b) which is electrically connected to an upper electrode (11c) of the coin cell."

After carefully reading said patent, differences between both embodiments can be noted, among which we can highlight at least the following:

- The stoppers from the above mentioned patent is designed to be reused, while the stoppers proposed in the present invention are disposable.
- The stoppers from the above mentioned patent shows a complete lengthwise hollow, while the stopper in the present invention shows only a partial hollowness.

- The stoppers from the above mentioned patent shows a conductive cylindrical surfaces and an upper electrode, while the stoppers in the present invention shows only a sealed capsule.
- The stoppers from the above mentioned patent show a complex parts set to make the assembly become a conductive mechanism while the stoppers in the present invention shows only a sealed capsule containing a lithium battery, a simple electronic circuit and a LED-type light.

After an exhaustive research of the background art, no more noteworthy background references have been found and none are known to contain the specifications, novelty and benefits associated with this patent expected to be granted.

DESCRIPTION OF THE INVENTION

The proposed invention relates to a bottle stoppers with a built in light specially developed to correctly visualize the state of the internal fluid and for liquids with bubbles verify the quantity, the quality and the size of the bubbles.

As an added side effect, the aesthetic appearance can be considered.

The stoppers of the invention is formed starting from a standard stopper, on which a inner hollow is carved so that it can accommodate an air-tight capsule formed into a cylinder with a rounded top part and where a battery and an electronic circuit that conducts the energy from the battery to a LED light can be seen, being said air tight capsule sealed on the bottom by means of a see through glass pane.

So that the air-tight capsule is not displaced in position within the stopper, several solutions have been various.

One of them is a set of flexible pins that are received within notches made on the inner walls of the stopper once it has been carved.

In another, the inner walls of the stopper are carved without any notches and the air-tight capsule is perfectly secured within the hollow carved by means of small pyramids at the top and sides of the air tight capsule and due to the pressure applied at the time of inserting the stopper into the bottleneck of the bottle leaving said pyramids stuck on the inner face of the hollow carved in the stopper.

For a better understanding of the invention, a sheet of drawings is attached in which the following can be seen:

FIG. 1. Schematic view of a central section of a stopper with the airtight capsule that provides the light.

Figure 2:
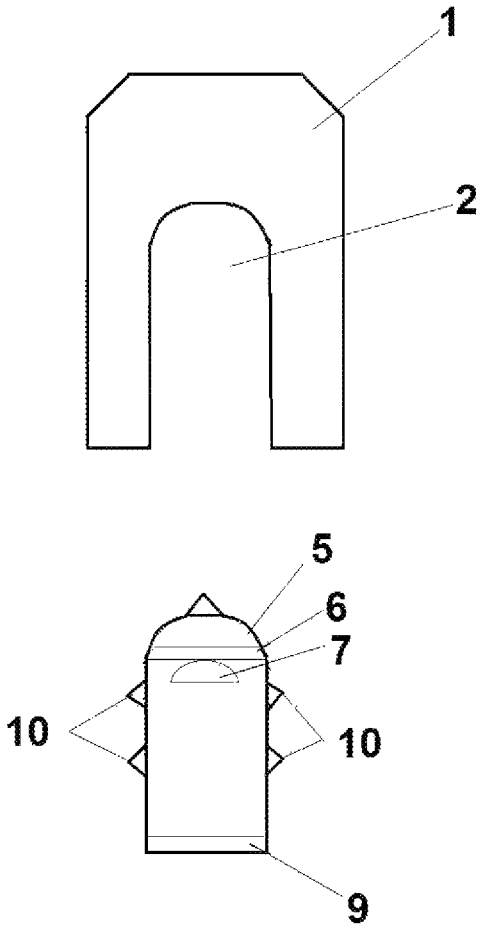

FIG. 2. Schematic view of a central section of a stopper with the air tight capsule which provides the light him with another detail for fixing the air tight capsule into the stopper.

In these figures, identical elements are referenced equally, among which the following can be told apart:

(1)—stopper,
(2)—hollow carved for insertion,
(3)—notches on the inner faces of the stopper,
(4)—air tight capsule,
(5)—lithium battery,
(6)—electronic circuit,
(7)—light providing LED,
(8)—flexible pins,
(9)—see-through glass pane,
(10)—pyramid-shaped protrusions for attachment.

PREFERRED EMBODIMENT OF THE INVENTION

The proposed invention relates to a bottle stoppers with a built in light specially developed to correctly visualize the state of the internal fluid and for liquids with bubbles verify the quantity, the quality and the size of the bubbles.

As an added side effect, the aesthetic appearance can be considered.

In a preferred embodiment of the invention the referenced stopper is formed from a standard stopper (1) preferably made in cork, to which an inner hollow has been carved inside (2) so that it can house an air tight cylindrical capsule (4) with a rounded top part and within which the following elements can be discerned:

A battery (5), preferably lithium because of the capacity and low weight, an electronic circuit (6) that connects the electrical power from the battery to a light providing LED (7) being said air tight capsule (4) sealed on the bottom by means of a see through glass pane (9).

So that the air-tight capsule (4) cannot be displaced out of position within the stopper, several flexible pins (8) have been provided that are housed within notches (3) made on the inner walls of the stopper (1) once made hollow inner space has been made (2).

The flexible pins (8) are completely attached into the grooves (3) and thus the air tight capsule (4) stays fully set within the cap when the assembly is inserted into the bottleneck of the bottle due to the tremendous pressure that is generated in this operation.

In another preferred embodiment, no notches are done to the inner walls of the stopper (1) after the inner hollow (2) has been made.

In this case, the air-tight capsule (4) has small pyramid-shaped protrusions (10) on its perimeter and on the top side.

Because the pressure applied at the time of inserting the stopper within the bottleneck of the bottle, said small pyramid-shaped protrusions (10) are driven deep into the inner face of the stopper thereby immobilizing the air-tight capsule inside the stopper.

Having sufficiently described the nature of the invention, as well as how to be implemented, it must be stated that the provisions referred to above and shown in the accompanying drawings are susceptible to change in detail as long as they do not alter the fundamental principles set out in the paragraphs above and summarized in the following claims.

The invention claimed is:

1. A stopper with built-in light characterized in that it is made up by the following parts:

I. Cork stopper (1) in which an inner hollow (2) has been made,

II. Cylindrical air-tight capsule (4) with a rounded top part that is housed in the inner hollow (2) formed in the cork (1) and consists of the following parts:

i. Battery (5)

ii. Electronic circuit (6)

iii. Light providing LED (7)

iv. Clear glass pane (9) acting as the closing element at the bottom of the air-tight capsule (4).

2. A stopper according to claim 1 and characterized in that so the air-tight capsule (4) is not displaced from its position within the stopper several flexible pins (8) have been provided with a straight hook shape.

3. A stopper according to claim 2, characterized in that on the inner side of the stopper (1) once emptied, a series of notches (3) of triangular shape are made.

4. A stopper according to claim 3 characterized in that when the stopper (1) is inserted by pressure in the bottleneck of the bottle, the flexible pins (8) are fixed into the notches (3).

5. A stopper according to claim 1 characterized in that the air-tight capsule (4) has on its outer perimeter and at its top side small pyramid-shaped protrusions (10).

6. A stopper according to claim 5 characterized in that due to the pressure at the time of inserting the plug within the bottleneck of the bottle, the small pyramid shaped protrusions (10) are fixed on the inner face of the stopper (1) immobilizing the air-tight capsule (4).

* * * * *